US007708159B2

(12) United States Patent
Darr et al.

(10) Patent No.: US 7,708,159 B2
(45) Date of Patent: May 4, 2010

(54) PLASTIC CONTAINER

(75) Inventors: Richard C. Darr, Medina, OH (US); Edward V. Morgan, Northville, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 1016 days.

(21) Appl. No.: 11/368,860

(22) Filed: Mar. 6, 2006

(65) Prior Publication Data

US 2007/0205175 A1 Sep. 6, 2007

(51) Int. Cl.
*B65D 1/02* (2006.01)
*B65D 90/02* (2006.01)

(52) U.S. Cl. ..... 215/384; 215/40; 215/379

(58) Field of Classification Search ..... 215/384, 215/40, 371, 379
See application file for complete search history.

(56) References Cited

U.S. PATENT DOCUMENTS 4,541,536 A 9/1985 Davis et al.
4,830,251 A 5/1989 Conrad
6,085,924 A 7/2000 Henderson
6,276,546 B1 * 8/2001 Davis et al. ..... 215/375
2003/0155320 A1 * 8/2003 Peronek et al. ..... 215/46
2004/0129669 A1 * 7/2004 Kelley et al. ..... 215/382
2005/0258127 A1 11/2005 Darr
2007/0257001 A1 * 11/2007 Paz ..... 215/44

OTHER PUBLICATIONS

International Searching Authority; PCT/US07/01880; International Search Report and Written Opinion mailed Nov. 19, 2007.

* cited by examiner

*Primary Examiner*—Anthony Stashick
*Assistant Examiner*—Niki M Eloshway
(74) *Attorney, Agent, or Firm*—Dykema Gossett PLLC

(57) ABSTRACT

A plastic container having a lower supporting base portion, a sidewall portion extending upwardly from the base portion, a neck portion extending upwardly from the sidewall portion and an opening at the top of the neck portion. The container is characterized by a lowered center of gravity which provides increased stability.

15 Claims, 4 Drawing Sheets

PLASTIC CONTAINER

BACKGROUND OF THE INVENTION

The present invention relates to plastic containers, preferably those used for carbonated products, such as soda, beer and carbonated water. More particularly, the present invention relates to molded plastic containers, such as injection molded and/or blow molded plastic containers.

It has long been desirable to improve the stability of plastic containers, particularly round plastic containers, to enhance the conveyance, palletizing and shipment of empty containers from the injection molder or blow molder to the container filler. This has been particularly true in the water, beer and beverage industries. In addition, during the filling process, stable empty plastic containers improve depalletizing, conveying and filling speeds. Bottlers and manufacturers generally move empty containers by means of table top conveyors, and transfer the plastic containers in and out of labeling, palletizers and fillers with transfer arms. The transfer arms can facilitate the containers falling over, and often the containers do fall over. This reduces filling efficiency, causes production difficulties and increases scrap. In many cases this causes jams in the manufacturing lines and creates a domino effect, knocking over other containers that may have similar unstable characteristics. The center of gravity of the empty plastic containers impacts the propensity of the container to tip over during the manufacturing, shipping and filling processes, i.e., the higher the center of gravity the more unstable the container.

In addition to the foregoing, consumers who drink beverages clearly desire more stable plastic containers. For example, when a container is opened, undesirably the volume of liquid can spill if the container is tipped at a certain angle by an irregular movement or a certain amount of uncontrolled force to the upper portion of the container. Thus consumers would clearly desire a more stable plastic container wherein the container does not easily tip and spill the contents of the container. The lower the center of gravity of the plastic container the more stable the container, whether the container is empty, partially filled or fully filled.

Therefore, it is a principal object of the present invention to provide a more stable plastic container.

It is a still further object of the present invention to provide a plastic container with an improved and lowered center of gravity, which provides a reduced tendency for the container to tip or fall.

It is an additional object of the present invention to improve the tip angle, i.e., the angle at which the container starts to fall, on plastic containers and thereby increasing the tipping angle for empty, partially filled or filled containers.

Further objects and advantages of the present invention will appear hereinbelow.

SUMMARY OF THE INVENTION

In accordance with the present invention the foregoing objects and advantages are readily obtained.

The plastic container of the present invention comprises:

a hollow body of plastic material having a lower supporting base portion, a side wall portion extending upwardly from the base portion, a neck portion extending upwardly from the sidewall portion, and an opening at the top of the neck portion;

wherein the neck portion has an upper screw threaded outer surface for holding a screw threaded closure, a tamper bead beneath the screw threaded outer surface having a top and bottom portion thereof, and a support ring beneath the tamper bead having a top and bottom portion thereof; and wherein the weight of the neck portion is from 2.5 to 4.4 grams and preferably from 3 to 4 grams.

Preferably, the distance from the top of the neck portion to the bottom of the tamper bead is from 0.310 inch to 0.525 inch and preferably from 0.400 inch to 0.420 inch, and the distance from the bottom of the tamper bead to the bottom of the support ring is from 0.250 inch to 0.125 inch and preferably from 0.175 inch to 0.200 inch.

The container is preferably a round container and may have a shoulder portion extending upwardly and inwardly from the sidewall portion to the neck portion. Advantageously, the container of the present invention has a lower center of gravity than a comparable container without the features of the present invention. Indeed, the ratio of center of gravity to height is lowered in the present containers by from 3 to 15 percent, and preferably over 5 percent and preferably from 8 to 10 percent.

In a preferred embodiment the tamper bead is discontinuous; however, one may also provide a continuous tamper bead. The container is for carbonated beverages, as soda, beer and carbonated water, as with a gas range of from 20 to 75 psi and essentially any suitable plastic material can be used.

The present invention also contemplates one or a plurality of protrusions in the tamper bead which preferably are equally spaced around the periphery thereof. These may desirably be located on the top or bottom of the tamper bead and serve to facilitate removal of the closure from the tamper evident band on the closure.

The present invention also provides an improved process for lowering the center of gravity of a plastic container for holding carbonated beverages, which comprises:

providing a hollow body of plastic material having a lower supporting base portion, a side wall portion extending upwardly from the base portion, a neck portion extending upwardly from the sidewall portion, and an opening at the top of the neck portion;

wherein the neck portion has an upper screw threaded outer surface for holding a screw threaded closure, a tamper bead beneath the screw threaded outer surface having a top and bottom portion thereof, and a support ring having a top and bottom portion thereof beneath the tamper bead; and including the steps of lowering the distance from the top of the neck portion to the bottom of tamper bead, lowering the distance from the bottom of the tamper bead to the bottom of the support ring, and reducing the weight of the neck portion.

Further features of the present invention will appear hereinbelow.

BRIEF DESCRIPTION OF THE DRAWINGS

The present invention will be more readily understandable from a consideration of the accompanying drawings, wherein.

DETAILED DESCRIPTION OF PREFERRED EMBODIMENTS

Figure 1:
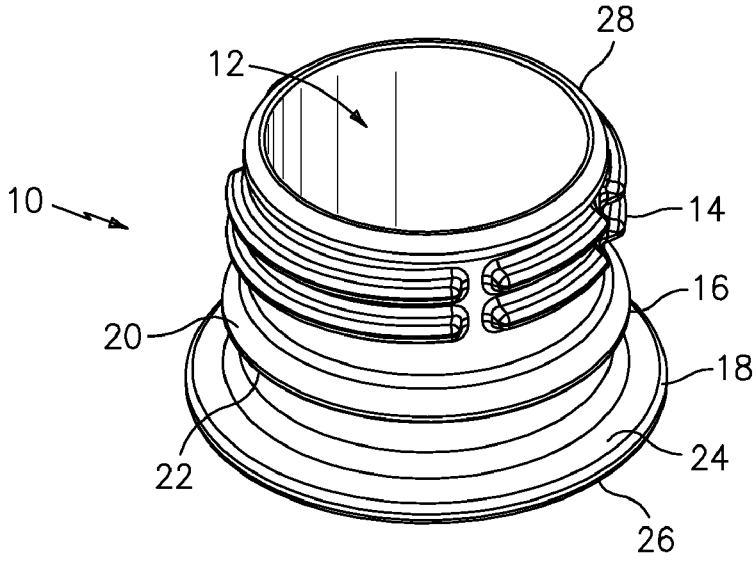
FIG. 1 (PRIOR ART)
FIG. 1 is a perspective view of a conventional neck portion for a hollow plastic container.
Figure 2:
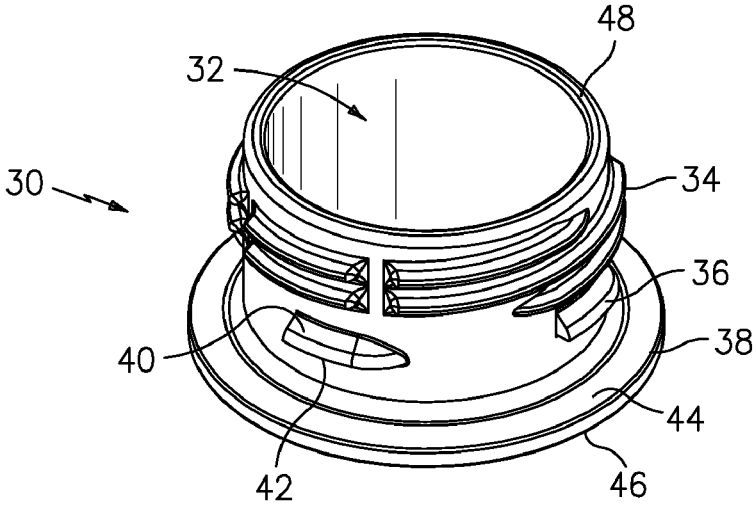
FIG. 2 is a perspective view of the neck portion of a hollow plastic container of the present invention.
Figure 3:
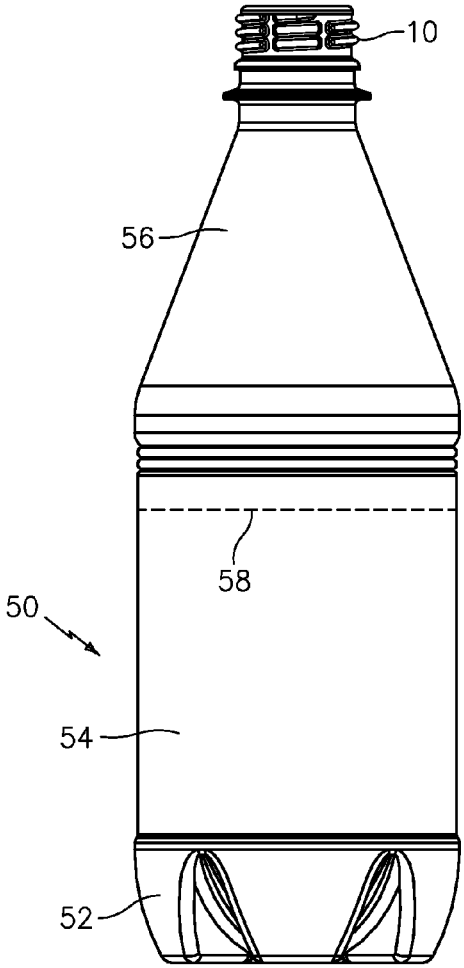
FIG. 3 (PRIOR ART)
FIG. 3 is a side elevational view of a conventional plastic container.
Figure 4:
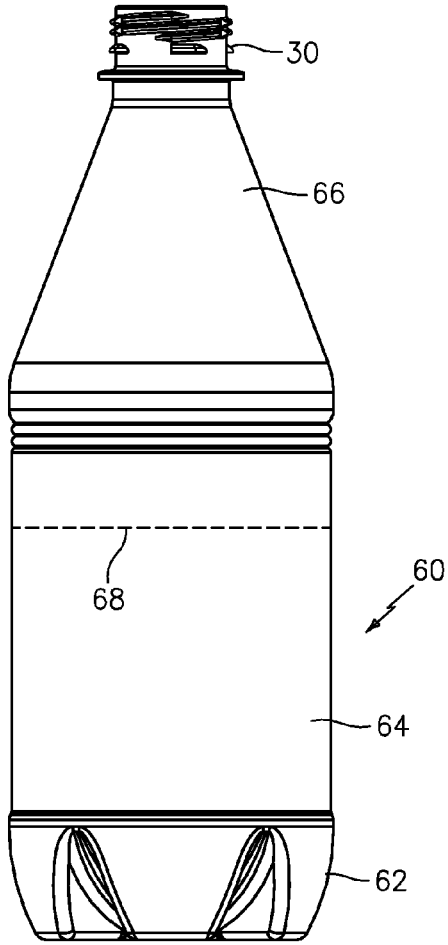
FIG. 4 is a side elevational view of an improved plastic container of the present invention based on the container configuration of FIG. 3.

Referring to the drawings, FIG. 1 shows a conventional neck portion 10 and FIG. 3 shows a first conventional plastic container 50 including the neck portion of FIG. 1. FIG. 2 shows the neck portion 30 of the present invention and FIG. 4 shows an improved container 60 of the present invention with the plastic container configuration of FIG. 3 and including the neck portion of FIG. 2.

The neck portion 10 of FIG. 1 includes an opening 12 at the top of the neck portion, an upper screw threaded outer surface 14 for holding a threaded closure, a tamper bead 16 beneath the screw threaded outer surface and running continuously around the circumference of the neck portion, and a support ring 18 beneath the tamper bead, also running continuously around the circumference of the neck portion and extending outwardly beyond the outward extent of the threaded portion and the tamper bead. The tamper bead 16 has a top portion 20 and a bottom portion 22, and the support ring 18 also has a top portion 24 and a bottom portion 26. The top of the neck portion 28 is also shown.

The neck portion 30 of FIG. 2 also includes an opening 32 at the top of the neck portion generally from 25 to 30 mm wide from the outer edge of the neck portion and preferably from 26 to 28 mm wide, an upper screw threaded outer surface 34 for holding a threaded closure, a tamper bead 36 beneath the screw threaded outer surface, and a support ring 38 beneath the tamper bead. However, in accordance with the preferred embodiment of the present invention, the tamper bead 36 runs discontinuously around the circumference of the neck portion while the support ring 38 runs continuously around the circumference of the neck portion and extends outwardly beyond the outward extent of the threaded portion and the tamper bead. The discontinuous tamper bead 36 has a top portion 40 and a bottom portion 42, and the support ring 38 also has a top portion 44 and a bottom portion 46. The top of the neck portion 48 is also shown.

Conventional hollow plastic container 50 of FIG. 3 includes the neck portion 10 of FIG. 1. Container 50 includes a lower supporting base portion 52, a sidewall portion 54 extending upwardly from the base portion and neck portion 10 extending upwardly from the sidewall portion. Container 50 also includes a shoulder portion 56 extending upwardly and inwardly from the sidewall portion to the neck portion, although many container configurations do not include a shoulder portion.

Hollow plastic container 60 of the present invention as shown in FIG. 4 includes the neck portion 30 of FIG. 2. Similar to container 50, the container 60 of the present invention includes a lower supporting base portion 62, a side wall portion 64 extending upwardly from the base portion, and neck portion 30 extending upwardly from the sidewall portion. Container 60 also includes shoulder portion 66 extending upwardly and inwardly from the sidewall to the neck portion.

The container configuration shown in FIG. 4 is representative only and a wide variety of shapes can be used with the neck portion of the present invention. Thus, many container configurations do not have a shoulder portion and a wide variety of base and sidewall configurations may be readily employed.

A key feature of the containers of the present invention is the lowering of the center of gravity. The lower the center of gravity the more stable the container and the less likely the container will tip during processing or handling. The center of gravity is the point at which if a body is suspended it would be perfectly balanced. For symmetrical bodies of uniform material the center of gravity is at the geometrical center. For non-symmetrical bodies the center of gravity needs to be determined.

The center of gravity of conventional container 50 of FIG. 3 is shown at 58; whereas the center of gravity of container 60 of the present invention is shown at 68. It can be seen that the center of gravity 68 is significantly lower than the center of gravity 58. This will be discussed further hereinbelow.

Key features of the plastic container 60 and neck portion 30 of the present invention include the following. The weight range of the neck portion is from 2.5 to 4.4 grams and preferably 3 to 4 grams. The distance from the top of the neck portion 48 to the bottom of the tamper bead 42 is from 0.310 inch to 0.525 inch, preferably from 0.400 inch to 0.420 inch. The distance from the bottom of the tamper bead 42 to the bottom of the support ring 46 is from 0.250 inch to 0.125 inch, preferably from 0.175 inch to 0.200 inch.

The center of gravity (COG) to height ratio is significant. This ratio allows one to normalize the center of gravity for containers of different heights into a consistent range. Conventional containers have a COG/height ration of from 0.4 to 0.6. In accordance with the present invention one can readily lower the ratio from 3 to 15% and preferably from 8 to 10%. For example, if the height of the container is 8.00 inches and the COG for that container is at 4.00 inches, the starting ratio is 0.5. In accordance with the present invention one can reduce this ratio to 0.4999 to 0.425, which is quite significant.

Comparing the conventional container 50 of FIG. 3 with the improved container 60 of the present invention of FIG. 4, the following improved results were obtained.

| FIG. 3 container | |
|---|---|
| Height | 8.480 inch |
| COG | 4.470 inch |
| COG/height ratio | 0.527 |

| FIG. 4 container | |
|---|---|
| Height | 8.250 inch |
| COG | 4.100 inch |
| COG/height ratio | 0.497 |
| Improvement | 5.7 percent |

The tilt angle is also significant. This refers to the angle at which the container tilts over. A test to determine tilt angle may be performed by placing the container on a horizontal surface. The surface is slowly inclined and the angle of the surface at which the container starts to fall is the tilt angle. In accordance with the present invention the tilt angle is increased by from 0.5 to 3 degrees, which is significant and validates the improved stability of the containers of the present invention.

Figure 5:
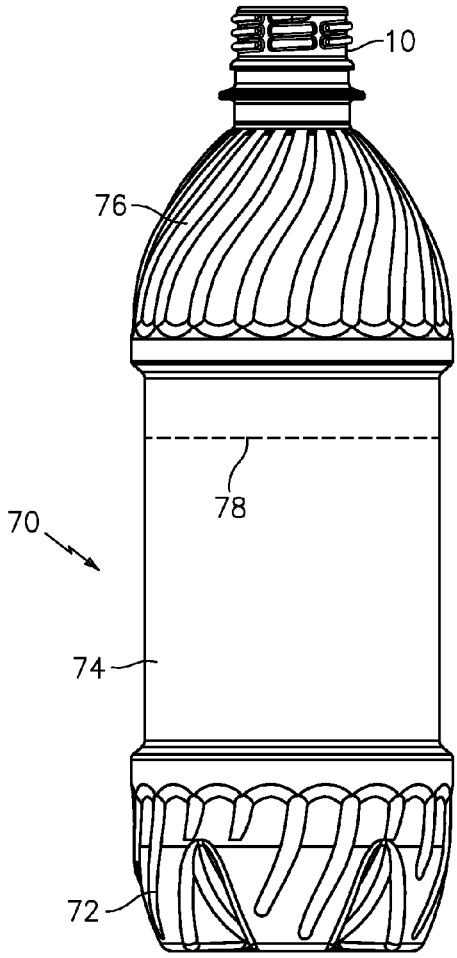
FIG. 5 (PRIOR ART)
FIG. 5 is a side elevational view of a second embodiment of a conventional plastic container.
Figure 6:
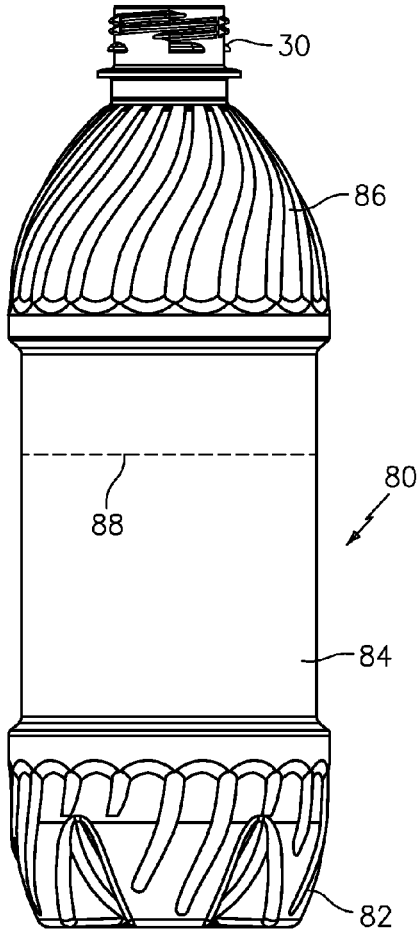
FIG. 6 is a side elevational view of an improved plastic container of the present invention based on the container configuration of FIG. 5.

FIG. 5 is a second embodiment of a conventional plastic container 70, and FIG. 6 is an improved container 80 of the present invention based on the container configuration of FIG. 5.

Conventional hollow plastic container 70 of FIG. 5 includes neck portion 10 of FIG. 1, a lower supporting base portion 72, a sidewall portion 74 extending upwardly from the base portion, and neck portion 10 extending upwardly from the sidewall portion. Container 70 also includes a shoulder portion 76 extending upwardly and inwardly from the sidewall portion. The COG is shown at 78.

Hollow plastic container 80 of the present invention shown in FIG. 6 includes the neck portion 30 of FIG. 2. Similar to container 70, the container 80 of the present invention includes a lower supporting base portion 82, a sidewall portion 84 extending upwardly from the base portion, shoulder portion 86 extending upwardly and inwardly from the sidewall portion, and neck portion 30 extending upwardly from the shoulder portion.

The center of gravity of conventional container 70 of FIG. 5 is shown at 78; whereas, the center of gravity of container 80 of the present invention is shown at 88. It can be clearly seen that the COG 88 is significantly lower than the COG 78. Moreover, a comparison of the conventional container 70 of FIG. 5 with the improved container 80 of the present invention of FIG. 6 gave the following improved results.

| FIG. 5 container | |
|---|---|
| Height | 8.750 inch |
| COG | 4.280 inch |
| COG/height ratio | 0.489 |

| FIG. 6 container | |
|---|---|
| Height | 8.520 inch |
| COG | 3.840 inch |
| COG/height ratio | 0.451 |
| Improvement | 7.9 percent |

Figure 7:
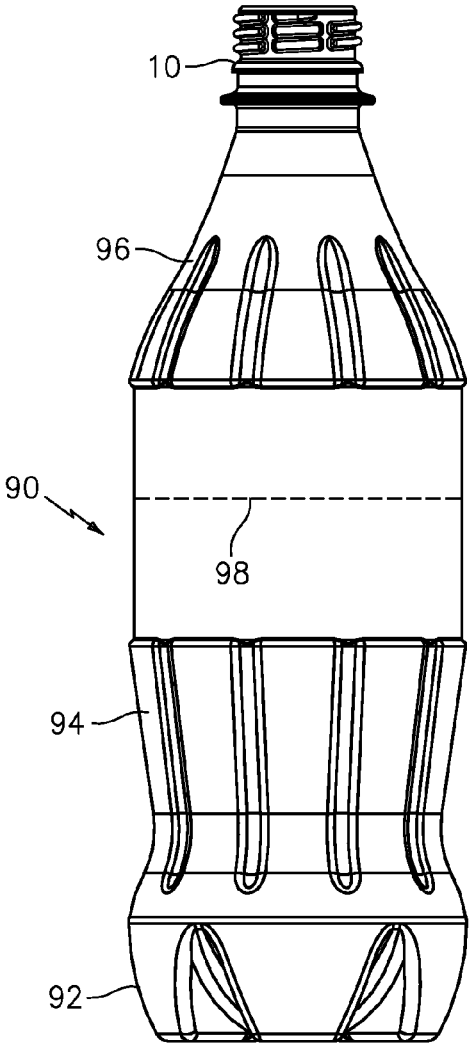
FIG. 7 (PRIOR ART)
FIG. 7 is a side elevational view of a third embodiment of a conventional plastic container.
Figure 8:
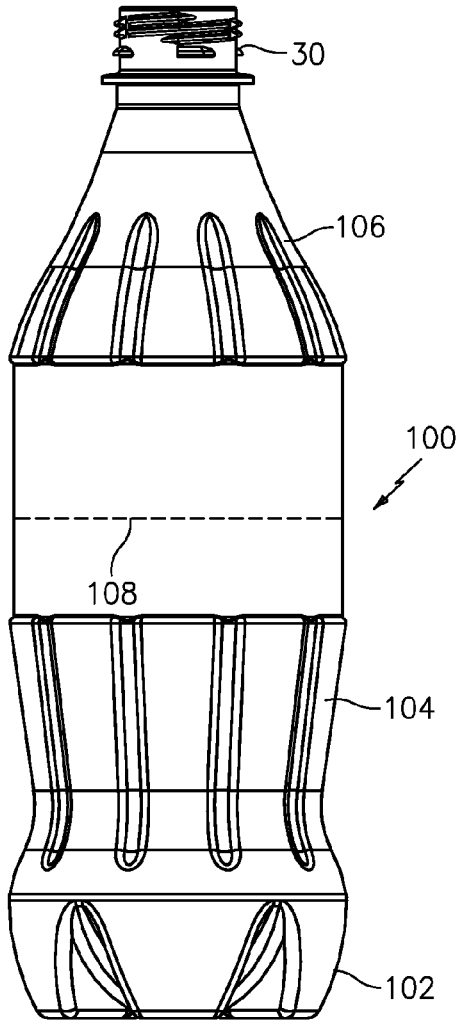
FIG. 8 is a side elevational view of an improved plastic container of the present invention based on the container configuration of FIG. 7.

FIG. 7 is a third embodiment of a conventional plastic container 90, and FIG. 8 is an improved container of the present invention 100 based on the container configuration of FIG. 7.

Conventional hollow plastic container 90 of FIG. 7 includes neck portion 10 of FIG. 1, a lower supporting base portion 92, a sidewall portion 94 extending upwardly from the base portion, and neck portion 10 extending upwardly from the sidewall portion. Container 90 also includes a shoulder portion 96 extending upwardly and inwardly from the sidewall portion. The COG is shown at 98.

Hollow plastic container 100 of the present invention shown in FIG. 8 includes the neck portion 30 of FIG. 2. Similar to container 90, the container 100 of the present invention includes a lower supporting base portion 102, a sidewall portion 104 extending upwardly from the base portion; shoulder portion 106 extending upwardly and inwardly from the sidewall portion, and neck portion 30 extending upwardly from the shoulder portion.

The center of gravity of conventional container 90 of FIG. 7 is shown at 98; whereas the center of gravity of container 100 of the present invention is shown at 108. It can be clearly seen that the COG 108 is significantly lower than the COG 98. Moreover, a comparison of the conventional container 90 of FIG. 7 with the improved container 100 of the present invention of FIG. 8 gave the following improved results.

| FIG. 7 container | |
|---|---|
| Height | 8.800 inch |
| COG | 4.35 inch |
| COG/height ratio | 0.494 |

| FIG. 8 container | |
|---|---|
| Height | 8.57 inch |
| COG | 4.04 inch |
| COG/height ratio | 0.471 |
| Improvement | 4.8 percent |

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container which comprises:

a hollow body of plastic material having a lower supporting base portion, a sidewall portion extending upwardly from the base portion, a neck portion extending upwardly from the sidewall portion, and an opening at the top of the neck portion;

wherein the neck portion has an upper screw threaded outer surface for holding a screw threaded closure, a tamper bead beneath the screw threaded outer surface having a top and bottom portion thereof, and a support ring beneath the tamper bead having a top and bottom portion thereof; and wherein the weight of the neck portion is from 2.5 to 4.4 grams, the opening at the top of the neck portion is round and from 25 to 30 mm wide, the ratio of center of gravity to container height is from 0.4999 to 0.425, and wherein said container is for holding carbonated beverages.

2. A plastic container according to claim 1, wherein the distance from the top of the neck portion to the bottom of the tamper bead is from 0.310 inch to 0.525 inch.

3. A plastic container according to claim 2, wherein the distance from the bottom of the tamper bead to the bottom of the support ring is from 0.250 inch to 0.125 inch.

4. A plastic container according to claim 3, wherein said container includes a shoulder portion extending upwardly and inwardly from the side wall portion to the neck portion.

5. A plastic container according to claim 3, wherein said container is round.

6. A plastic container according to claim 3, having a round opening from 26 to 28 mm wide.

7. A plastic container according to claim 3, for holding carbonated beverages with a gas range of from 20 to 75 psi.

8. A plastic container according to claim 3, wherein the tamper bead is discontinuous.

9. A process for lowering the center of gravity of a plastic container for holding carbonated beverages, which comprises:

providing a hollow body of plastic material having a lower supporting base portion, a sidewall portion extending upwardly from the base portion, a neck portion extending upwardly from the sidewall portion, and an opening at the top of the neck portion, the opening being from 25 to 30 mm wide;

wherein the neck portion has an upper screw threaded outer surface for holding a screw threaded closure, a tamper bead beneath the screw threaded outer surface having a top and bottom portion thereof, and a support ring beneath the tamper bead having a top and bottom portion thereof; and including the steps of lowering the distance from the top of the neck portion to the bottom of the tamper bead, lowering the distance from the bottom of the tamper bead to the bottom of the support ring, reducing the weight of the neck portion to within the range of 2.5 to 4.4 grams, and the lowering the ratio of center of gravity to container height to from 0.4999 to 0.425.

10. A process according to claim 9, wherein the weight of the neck portion is reduced to from 3 to 4 grams.

11. A process according to claim 9, wherein the distance from the top of the neck portion to the bottom of the tamper bead is lowered to from 0.310 inch to 0.525 inch.

12. A process according to claim 11, wherein the distance from the bottom of the tamper bead to the bottom of the support ring is lowered to from 0.250 inch to 0.125 inch.

13. A process according to claim 12, including the step of providing that said container has a round opening from 26 to 28 mm wide.

14. A process according to claim 9, including the step of providing a discontinuous tamper bead.

15. A process according to claim 9, including the step of providing that the carbonated beverage has a gas range of from 20 to 75 psi.

* * * * *